US008033449B2

(12) United States Patent
Ho Fung et al.

(10) Patent No.: US 8,033,449 B2
(45) Date of Patent: Oct. 11, 2011

(54) CARTONS HAVING DISPENSING CONFIGURATIONS

(75) Inventors: Charles F. Ho Fung, Woodstock, GA (US); Jean-Manuel Gomes, Marietta, GA (US); Barry D. Biddle, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 195 days.

(21) Appl. No.: 12/348,417

(22) Filed: Jan. 5, 2009

(65) Prior Publication Data

US 2009/0145954 A1 Jun. 11, 2009

Related U.S. Application Data

(63) Continuation-in-part of application No. 11/767,871, filed on Jun. 25, 2007, now Pat. No. 7,743,944, application No. 12/348,417.

(60) Provisional application No. 60/815,967, filed on Jun. 23, 2006, provisional application No. 61/018,718, filed on Jan. 3, 2008.

(51) Int. Cl.
*B65D 5/72* (2006.01)
*B65D 17/32* (2006.01)

(52) U.S. Cl. ..... 229/122.1; 221/302; 229/235; 229/240; 229/242

(58) Field of Classification Search ..... 229/122.1, 229/235, 240, 242; 206/427; 222/302, 305; 221/302, 305
See application file for complete search history.

(56) References Cited

U.S. PATENT DOCUMENTS

| | | | | |
|---|---|---|---|---|
| 1,656,919 | A | | 1/1928 | Marsh |
| 1,901,483 | A | | 3/1933 | Ware, Jr. |
| 1,925,102 | A | | 9/1933 | Levkoff |
| 2,027,079 | A | | 1/1936 | Weiss |
| 2,131,391 | A | | 9/1938 | Schraffenberger |
| 2,141,743 | A | | 12/1938 | Ethridge |
| 2,145,430 | A | | 1/1939 | New |
| 2,152,079 | A | | 3/1939 | Mott |
| 2,299,027 | A | * | 10/1942 | Novak ..... 229/122.1 |
| 2,983,372 | A | | 5/1961 | Amatel et al. |
| 3,002,613 | A | | 10/1961 | Merkel |
| 3,056,665 | A | * | 10/1962 | Raymond et al. ..... 229/120.09 |
| 3,139,979 | A | | 7/1964 | Russell |
| 3,194,474 | A | | 7/1965 | Rumberger |
| 3,215,332 | A | | 11/1965 | Bess |
| 3,263,900 | A | | 8/1966 | Link et al. |

(Continued)

FOREIGN PATENT DOCUMENTS

DE 2 320 190 11/1973

(Continued)

OTHER PUBLICATIONS

Office Action mailed May 13, 2009, for related U.S. Appl. No. 11/767,871.

(Continued)

*Primary Examiner* — Gary Elkins
(74) *Attorney, Agent, or Firm* — Womble Carlyle Sandridge & Rice, PLLC

(57) ABSTRACT

Cartons can be placed in dispensing configurations by separating the carton into carton sections. The carton sections may be connected by a hinge that allows the carton sections to stand side-by-side. The carton sections can have a dispenser section in at least one of the side panels for dispensing articles from the carton sections.

41 Claims, 11 Drawing Sheets

U.S. PATENT DOCUMENTS

| | | | | |
|---|---|---|---|---|
| 3,276,665 | A | 10/1966 | Rasmussen | |
| 3,280,968 | A | 10/1966 | Craine | |
| 3,300,115 | A * | 1/1967 | Schauer | 221/305 |
| 3,397,832 | A | 8/1968 | Thiele | |
| 3,517,858 | A * | 6/1970 | Farquhar | 221/305 |
| 3,653,495 | A | 4/1972 | Gray | |
| 3,759,378 | A | 9/1973 | Werth | |
| 3,786,914 | A | 1/1974 | Beutler | |
| 3,884,348 | A | 5/1975 | Ross | |
| 4,008,849 | A | 2/1977 | Baber | |
| 4,113,100 | A | 9/1978 | Soja | |
| 4,519,538 | A * | 5/1985 | Omichi | 206/746 |
| 4,558,785 | A | 12/1985 | Gordon | |
| 4,742,917 | A | 5/1988 | Bornwasser | |
| 4,773,541 | A | 9/1988 | Riddell | |
| 4,793,487 | A | 12/1988 | Bentsen et al. | |
| 4,815,609 | A | 3/1989 | Kiedaisch | |
| 4,886,160 | A | 12/1989 | Kligerman | |
| 5,181,650 | A | 1/1993 | Hollander et al. | |
| 5,368,194 | A | 11/1994 | Oliff et al. | |
| 5,505,372 | A * | 4/1996 | Edson et al. | 229/121 |
| 5,699,957 | A | 12/1997 | Blin et al. | |
| 5,722,583 | A | 3/1998 | Focke et al. | |
| 5,788,117 | A | 8/1998 | Zimmanck | |
| 5,842,576 | A | 12/1998 | Snow | |
| 5,857,570 | A | 1/1999 | Brown | |
| 5,878,947 | A | 3/1999 | Hoy et al. | |
| 5,881,884 | A | 3/1999 | Podosek | |
| 5,921,398 | A | 7/1999 | Carroll | |
| 5,927,498 | A | 7/1999 | Saam | |
| 5,979,749 | A | 11/1999 | Bozich | |
| D419,440 | S | 1/2000 | Hansen | |
| D431,462 | S | 10/2000 | Menaged et al. | |
| 6,129,211 | A | 10/2000 | Prakken et al. | |
| 6,135,289 | A | 10/2000 | Miller | |
| 6,419,152 | B1 | 7/2002 | Tokarski | |
| 6,435,351 | B1 | 8/2002 | Gibb | |
| 6,478,159 | B1 | 11/2002 | Taylor | |
| 6,510,982 | B2 | 1/2003 | White | |
| 6,523,692 | B2 | 2/2003 | Gregory | |
| 6,604,677 | B1 * | 8/2003 | Sutherland et al. | 229/242 |
| 6,913,189 | B2 | 7/2005 | Oliff et al. | |
| 6,923,365 | B2 | 8/2005 | Auclair et al. | |
| 7,021,468 | B2 | 4/2006 | Cargile | |
| 7,225,930 | B2 | 6/2007 | Ford et al. | |
| 7,284,662 | B2 | 10/2007 | DeBusk et al. | |
| 7,328,834 | B2 | 2/2008 | Harrelson | |
| 7,712,653 | B2 | 5/2010 | DeBusk et al. | |
| 7,743,944 | B2 | 6/2010 | Ho Fung et al. | |
| 7,784,675 | B2 | 8/2010 | Sutherland et al. | |
| 2001/0001447 | A1 | 5/2001 | Gregory | |
| 2002/0043554 | A1 | 4/2002 | White | |
| 2002/0170845 | A1 | 11/2002 | Oliff | |
| 2004/0099570 | A1 | 5/2004 | Cargile | |
| 2005/0092649 | A1 | 5/2005 | Ford et al. | |
| 2005/0115843 | A1 * | 6/2005 | Harrelson | 206/170 |
| 2005/0167291 | A1 * | 8/2005 | Sutherland | 206/170 |
| 2005/0189405 | A1 | 9/2005 | Gomes et al. | |
| 2005/0199690 | A1 | 9/2005 | Peterson | |
| 2006/0065703 | A1 | 3/2006 | DeBusk | |
| 2006/0091191 | A1 | 5/2006 | DeBusk | |
| 2006/0091193 | A1 * | 5/2006 | DeBusk et al. | 229/122.1 |
| 2006/0243739 | A1 | 11/2006 | Sherman et al. | |
| 2006/0266815 | A1 | 11/2006 | Coltri-Johnson et al. | |
| 2007/0000934 | A1 | 1/2007 | Wolpow | |
| 2007/0131749 | A1 * | 6/2007 | Coltri-Johnson et al. | 229/122.1 |
| 2007/0210144 | A1 * | 9/2007 | Brand | 229/122.1 |
| 2007/0278120 | A1 * | 12/2007 | Ho Fung et al. | 206/427 |
| 2007/0295789 | A1 | 12/2007 | Ho Fung | |
| 2007/0295790 | A1 * | 12/2007 | Zammit et al. | 229/122 |
| 2009/0057384 | A1 * | 3/2009 | Learn | 229/117.16 |

FOREIGN PATENT DOCUMENTS

| | | | |
|---|---|---|---|
| EP | 0 704 386 | A1 | 4/1996 |
| FR | 1.379.931 | | 12/1963 |
| GB | 1.218.016 | | 1/1971 |
| WO | WO 98/31593 | | 7/1998 |
| WO | WO 03/082686 | A1 | 10/2003 |
| WO | WO 2004/063031 | A1 | 7/2004 |
| WO | WO 2005/110866 | A1 | 11/2005 |

OTHER PUBLICATIONS

Office Action mailed Jun. 11, 2009, for related U.S. Appl. No. 11/767,959.

Response to Office Action mailed Dec. 24, 2008, filed Mar. 30, 2009 in related U.S. Appl. No. 11/767,959.

Office Action for related co-pending U.S. Appl. No. 11/767,871, mailed Oct. 14, 2009.

International Search Report—PCT/US2007/072006.

Written Opinion—PCT/US2007/2006.

Office Action mailed Dec. 24, 2008 in related U.S. Appl. No. 11/767,959, filed Jun. 25, 2007, Robert L. Sutherland.

Office Action mailed Nov. 12, 2008 in related U.S. Appl. No. 11/767,871, filed Jun. 25, 2007, Charles F. Ho Fung.

Response filed Feb. 3, 2009 in related U.S. Appl. No. 11/767,871, filed Jun. 25, 2007, Charles F. Ho Fung.

* cited by examiner

CARTONS HAVING DISPENSING CONFIGURATIONS

CROSS REFERENCE TO RELATED APPLICATIONS

This application is a Continuation-In-Part of prior U.S. patent application Ser. No. 11/767,871, filed Jun. 25, 2007, which claims the benefit of U.S. Provisional Application No. 60/815,967, filed Jun. 23, 2006. This application also claims the benefit of U.S. Provisional Application No. 61/018,718, filed Jan. 3, 2008. Each of the above-referenced applications is incorporated by reference for all purposes as if presented herein in their entirety.

BACKGROUND OF THE DISCLOSURE

The present disclosure generally relates to cartons for holding and dispensing beverage containers or other types of articles. More specifically, the present disclosure relates to cartons being configurable into dispensing sections.

SUMMARY OF THE DISCLOSURE

According to a first embodiment, a carton accommodates a plurality of articles. The carton includes a tear feature that allows the carton to be placed in a first dispensing configuration. In the first dispensing configuration, the carton is separated into two sections, with each carton section accommodating a portion of the articles. The carton can include a hinge connecting the two carton sections and about which the carton sections are pivoted to place the carton in the first dispensing configuration.

According to an aspect of the disclosure, the carton sections may be completely separated from one another to place the carton in a dispensing configuration.

According to yet another aspect of the disclosure, one or both of the carton sections may be provided with a dispenser pattern that defines a dispenser section. The dispenser section allows a carton section to be placed in a second dispensing configuration.

According to yet another aspect of the disclosure, dispenser sections at bottom corners of one or both carton sections can be opened and containers dispensed through the open bottom corners.

According to yet another aspect of the disclosure, dispenser sections with pivotable door portions at bottom front portions of one or both carton sections can be opened and containers dispensed through the open front portions.

According to yet another aspect of the disclosure, dispenser sections at bottom front portions of one or both carton sections can be opened and stop portions formed at the open front portions.

Those skilled in the art will appreciate the above-stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWING FIGURES

DETAILED DESCRIPTION OF THE DISCLOSURE

Figure 1:
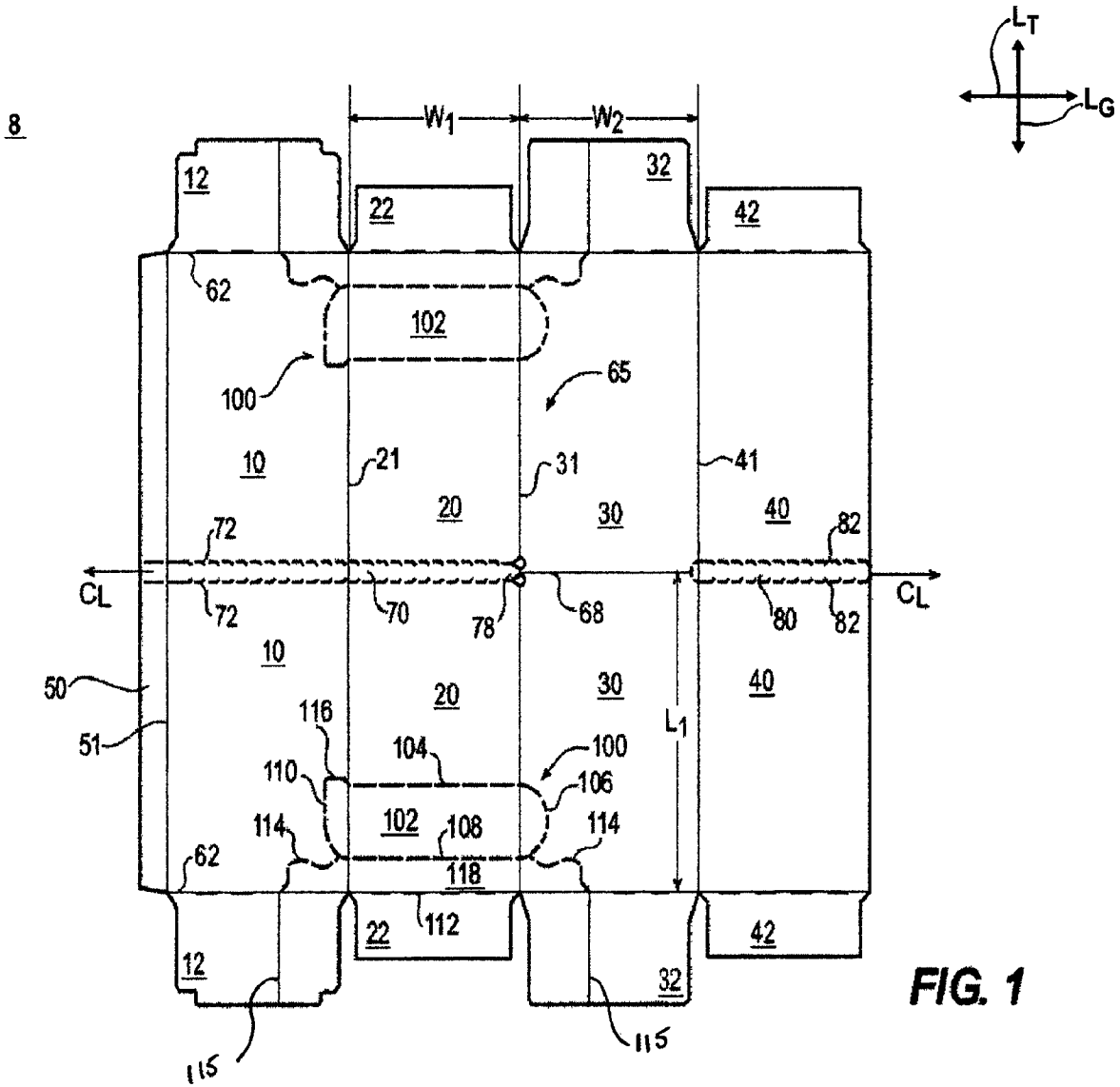
FIG. 1 is a plan view of a blank from which a carton according to a first embodiment of the disclosure is formed.

The present disclosure generally relates to cartons capable of being placed in dispensing configurations by separating the carton into carton sections. The present disclosure can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the present disclosure, the following detailed description describes generally cylindrical beverage containers as disposed within the illustrated carton embodiments.

To facilitate understanding and explanation of the blank of the present disclosure, the elements and numerals described herein utilize the terms "end" and "side" to distinguish portions of the carton and of the blank. These conventions are included merely for ease of explanation and understanding of the present description, however, and should not be limiting in any manner. The descriptions of the panels as "end" and "side" etc., also can be referred to as "first," "second," etc. The terms "end" and "side" are not intended to connote relative size differences between elements in the drawing figures.

FIG. 1 is a plan view of the exterior or print side of a blank 8 that can be used to form a carton 150 (illustrated in FIG. 2) according to a first embodiment of the disclosure. As shown in FIG. 1, the blank 8 may be symmetric or nearly symmetric about a lateral center line $C_L$. Therefore, certain elements in the drawing figures are indicated by like or similar reference numerals in order to reflect the longitudinal symmetry. The longitudinal direction of the blank is indicated by the longitudinal axis $L_G$ in FIG. 1, and the lateral direction of the blank is indicated by the lateral axis $L_T$ in FIG. 1. The blank 8 comprises a pair of first side panels 10, each first side panel 10 being foldably connected to a second side panel 20 at a first longitudinal fold line 21, a pair of third side panels 30, each third side panel 30 being foldably connected to a second side panel 20 at a second longitudinal fold line 31, and a pair of fourth side panels 40, each fourth side panel 40 being foldably connected to a third side panel 30 at a third longitudinal fold line 41. An adhesive flap 50 may be foldably connected at a fourth longitudinal fold line 51.

Each first side panel 10 is foldably connected at one end to a first end flap 12. Each second side panel 20 is foldably connected at one end to a second end flap 22. Each third side panel 30 is foldably connected at one end to a third end flap 32. Each fourth side panel 40 is foldably connected at one end to a fourth end flap 42. The end flaps 12, 22, 32, 42 may be arranged along marginal areas of the blank 8, and may be foldably connected along laterally extending fold lines 62. The lateral fold lines 62 may be straight or substantially straight fold lines, or may be offset at one or more locations to account for blank thickness, for example. When the carton 150 is erected, the end flaps 12, 22, 32, 42 close each end of the carton 150.

According to one aspect of the first embodiment, the blank 8 includes a tear pattern 65 of lines of disruption that bifurcate the blank and allow the erected carton 150 (FIG. 2) constructed from the blank to be placed in a first dispensing configuration. The tear pattern 65 includes a first tear feature 70 that separates the pairs of side panels 10, 20 and extends adjacent to a lateral hinge line 68 that separates (e.g., defines a boundary between) and foldably connects the side panels 30. The first tear feature 70 can be, for example, a tear strip defined by spaced breachable lines of disruption 72, which may be tear lines. A tear tab 78 can be provided at the end of the first tear feature 70. The hinge line 68 extends adjacent to a second tear feature 80 that separates the side panels 40. The second tear feature 80 can be, for example, a tear strip defined by spaced breachable lines of disruption 82.

A dispenser pattern 100 can be formed in one or both halves of the blank 8; because the dispenser patterns 100 are substantially mirror images of one another about the lateral center line $C_L$ in the illustrated embodiment, reference numbers are only shown for one dispenser pattern 100 in the figures. Each dispenser pattern 100 is comprised of lines of disruption defining a dispenser section 102. Each dispenser pattern 100 includes a laterally extending upper portion 104, a first side portion 106, a laterally extending lower portion 108, and a second side portion 110. An access flap 116 can be defined at one corner of the dispenser section 102. The dispenser pattern 100 also includes a base hinge line 112 and curved base lines 114 that in part define a pivot portion 118 at the base of the dispenser section 102.

The lines 72, 82, 104, 106, 108, 110, 114 can be breachable lines of disruption formed from continuous or substantially continuous tear lines formed by, for example, scores, creases, cuts, gaps, cut/creases, perforations, offset cuts, and overlapping and/or sequential combinations thereof. If cuts are used to form the tear lines 72, 82, 104, 106, 108, 110, 114, the cuts may be, for example, interrupted by breachable nicks. The hinge line 68 can be, for example, any line of disruption between the panels 30 that facilitates hinged folding or pivoting of the blank 8.

Figure 6:
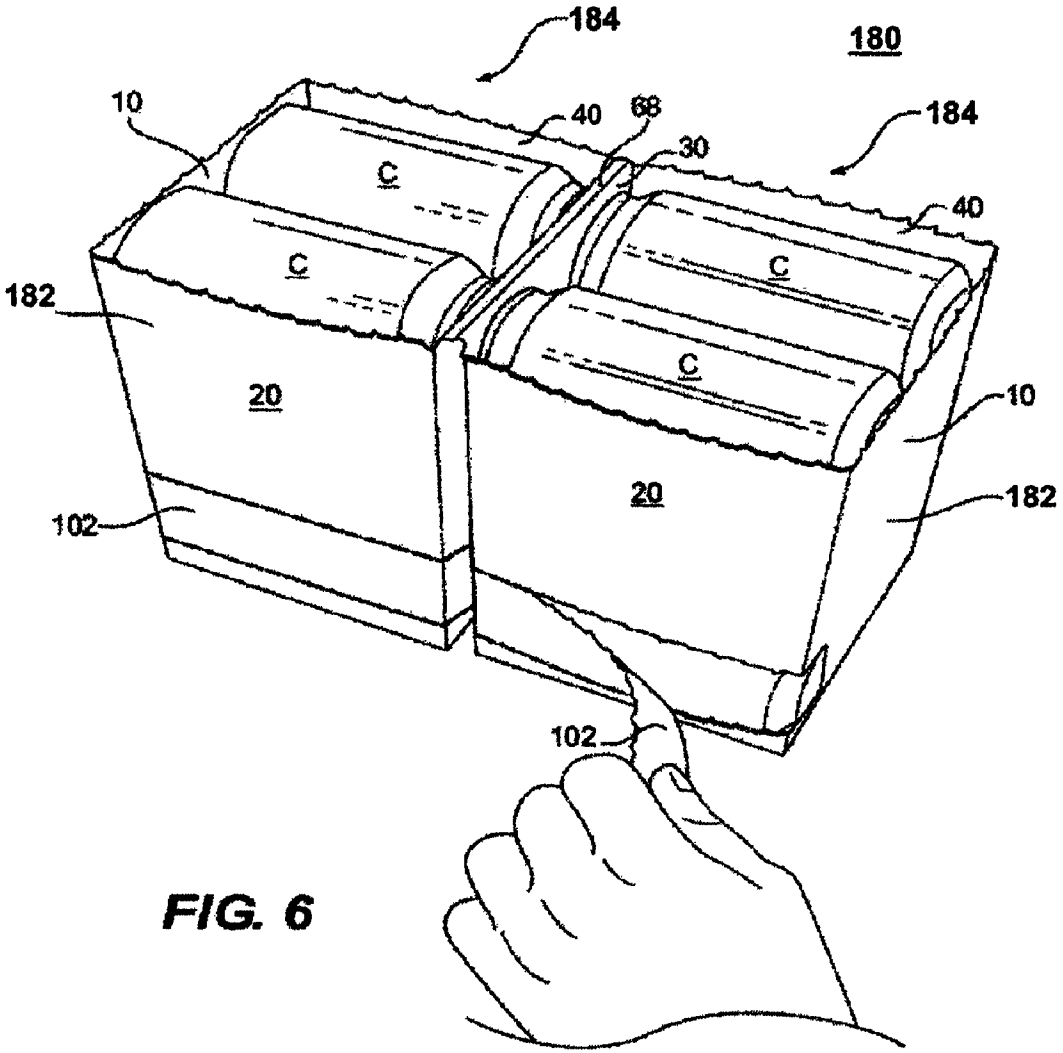
FIG. 6 illustrates the first carton embodiment in the first dispensing configuration.
Figure 7:
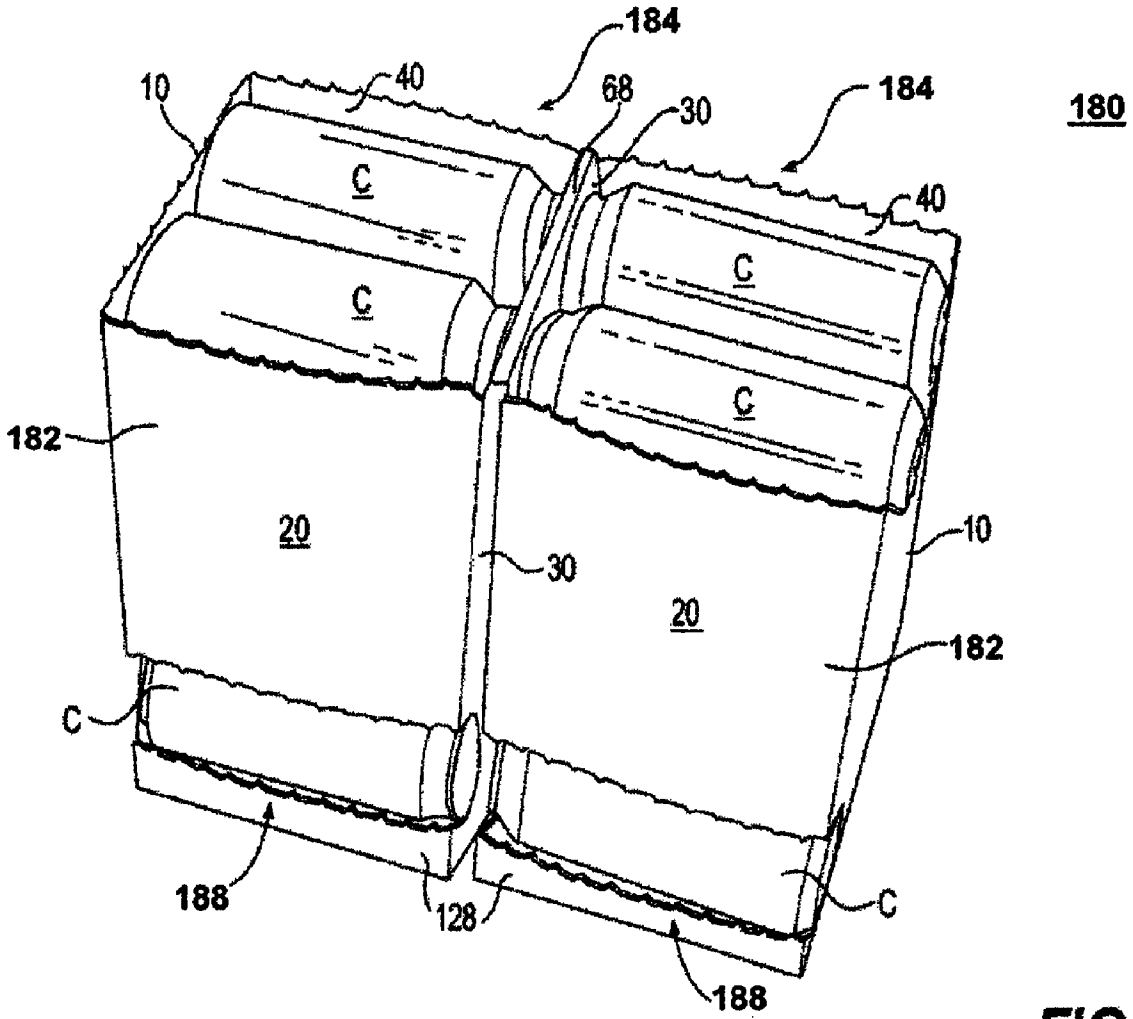
FIG. 7 illustrates the first carton embodiment in a second dispensing configuration.

The dimensions of the blank 8 may be selected to accommodate characteristic dimensions of articles to be accommodated within the carton 150. For example, in one embodiment, the side panels 20 (as well as the side panels 40) can have a width $W_1$ that generally corresponds to or slightly exceeds a height (measured from bottom to top) of containers C (illustrated in FIG. 5) or other articles to be accommodated within the carton 150. When cylindrical or substantially cylindrical containers C are used in the carton, the side panels 30 (as well as the side panels 10) can have, for example, a width $W_2$ that generally corresponds to or slightly exceeds an integral multiple of a largest (e.g., "characteristic") diameter of the containers C. The length $L_1$ of the panels 30 can also generally correspond to or slightly exceed an integral multiple of the characteristic diameter. The length $L_1$ may be the same ore different than the width $W_2$, e.g., the panel 40 has a width $W_2$ of three times the characteristic diameter and a length $L_1$ of two times the characteristic diameter in the illustrated embodiment. However, the width $W_2$ and the length $L_1$ may both be three times the characteristic diameter in an alternate embodiment, for example. The length $L_1$ will approximate the height of the carton in its dispensing configurations (FIGS. 6 and 7). If multiple generally cylindrical containers C, such as beverage containers, are to be accommodated in the carton, it may be expected that the generally cylindrical containers will share at least one substantially equal common largest diameter.

An exemplary method of erection of the carton 150 is discussed below with reference to FIGS. 1 and 2.

Referring to FIG. 1, the carton 150 may be erected from the blank 8 by folding the blank flat at each of the longitudinal fold lines 21, 41 so that the underside of the fourth side panels 40 can be glued or otherwise adhered to the glue flap 50. The distal end of the second tear feature 80 is adhered to the distal end of the first tear feature 70 in the adhesive flap 50 so that they may act in unison. The side panels 10, 20, 30, 40 may then be opened to a generally tubular or sleeve form.

Each end of the generally tubular sleeve form may be closed, for example, by folding the end flaps 22, 42 inwardly across the open end, followed by inwardly folding the end flap 12, then folding the end flap 32 inwardly. At each end of the tubular carton form, the interior side of each end flap 12 can be adhered to the end flaps 22, 42, and the interior side of each end flap 32 can be adhered to one or more of the end flaps 12, 22, 42. Substantially cylindrical containers C or other articles, for example, may be loaded into the tubular sleeve in a conventional manner at any time before one or both ends of the carton are closed by the end flaps 12, 22, 32, 42. In the exemplary embodiment, the carton 150 accommodates twelve containers C in two rows and six columns.

Figure 2:
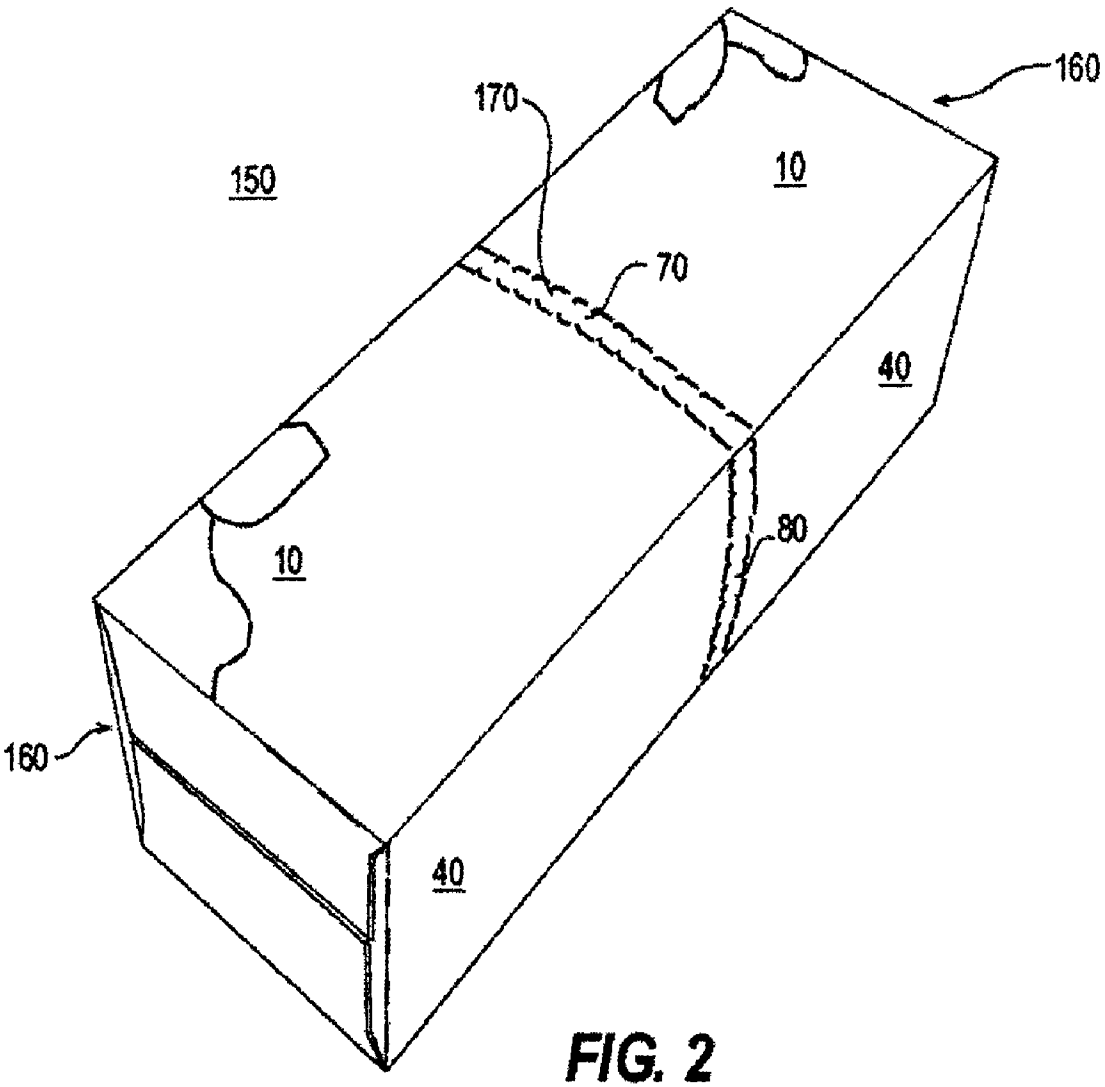
FIG. 2 illustrates the first carton embodiment.

FIG. 2 is a perspective view of the carton 150 erected from the blank 8 illustrated in FIG. 1. In the erected carton 150, the overlapped end flaps 12, 22, 32, 42 form an end panel 160 at each end of the carton 150. With the ends closed, the carton 150 has a substantially parallelepipedal shape. The sequentially arranged tear features 70, 80 extend partially around the perimeter of the carton 150 (e.g., around three sides of the carton) and comprise a tear strip 170.

Figure 3:
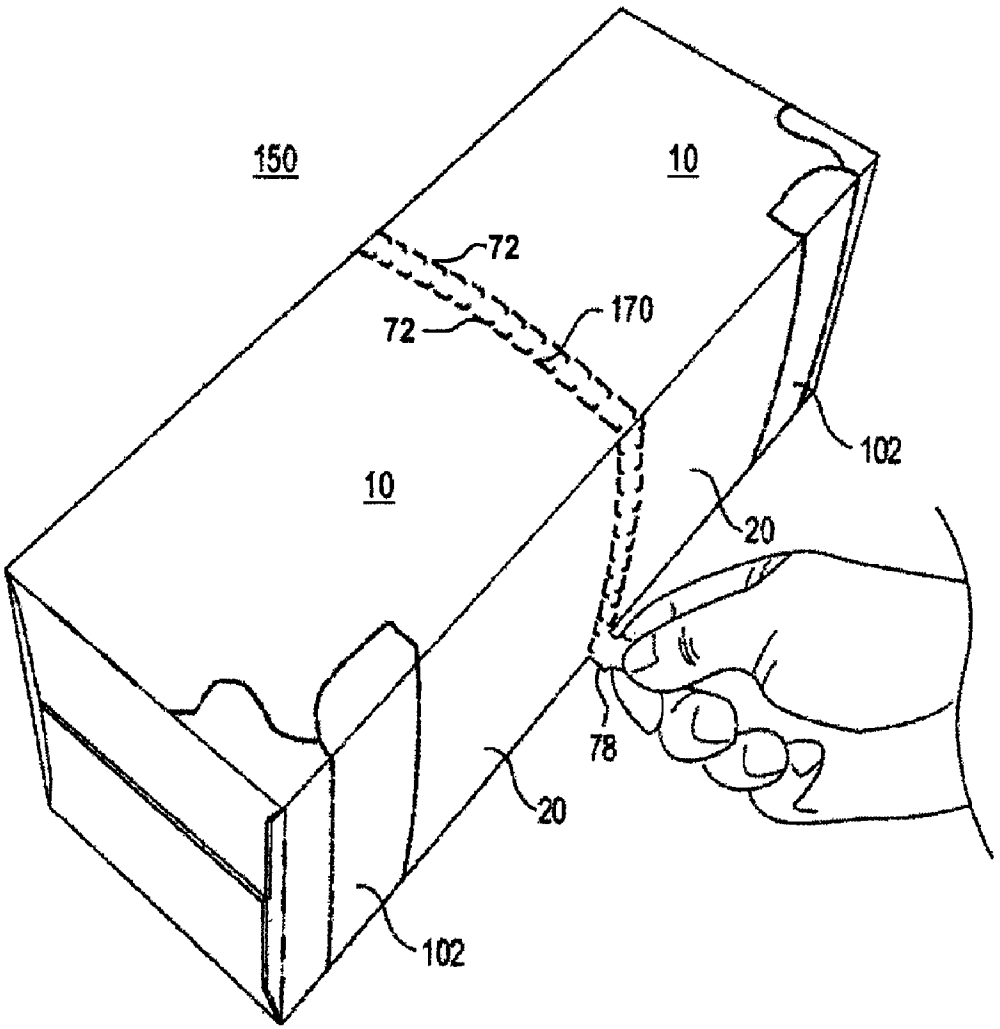
FIGS. 3-5 illustrate placing the first carton embodiment into a first dispensing configuration.
Figure 4:
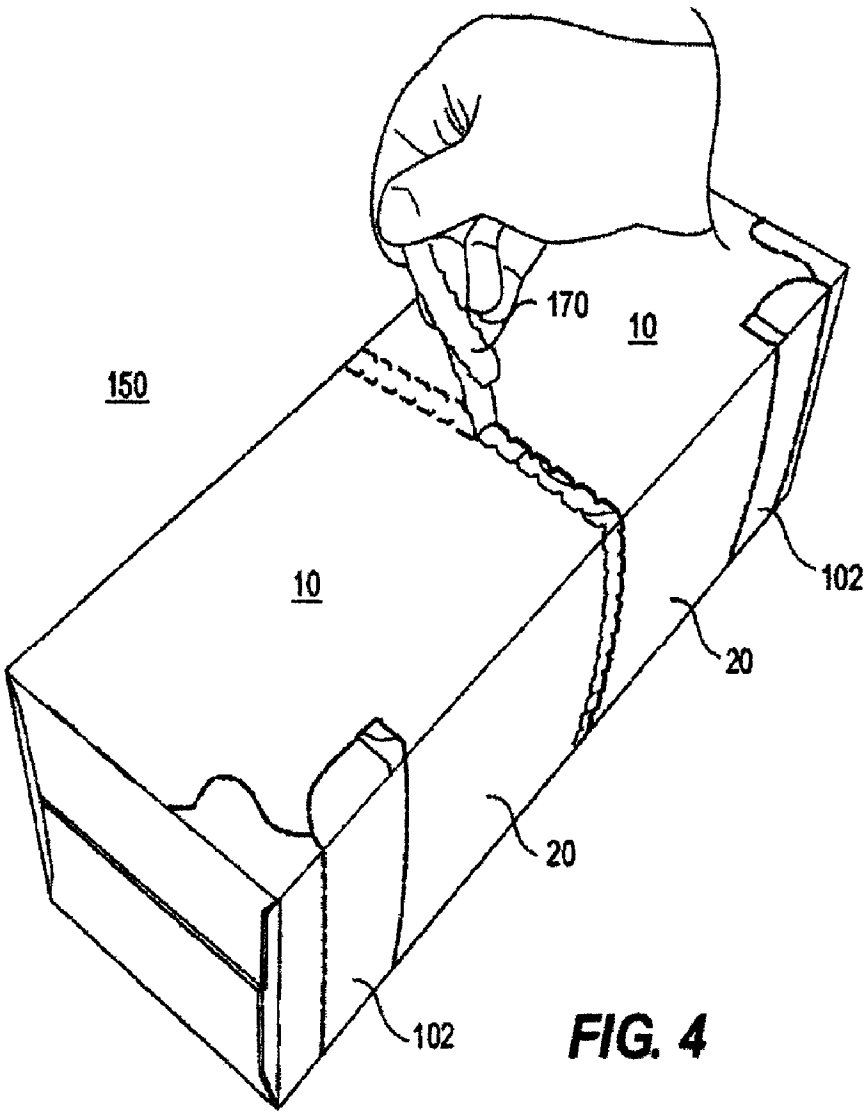
Figure 5:
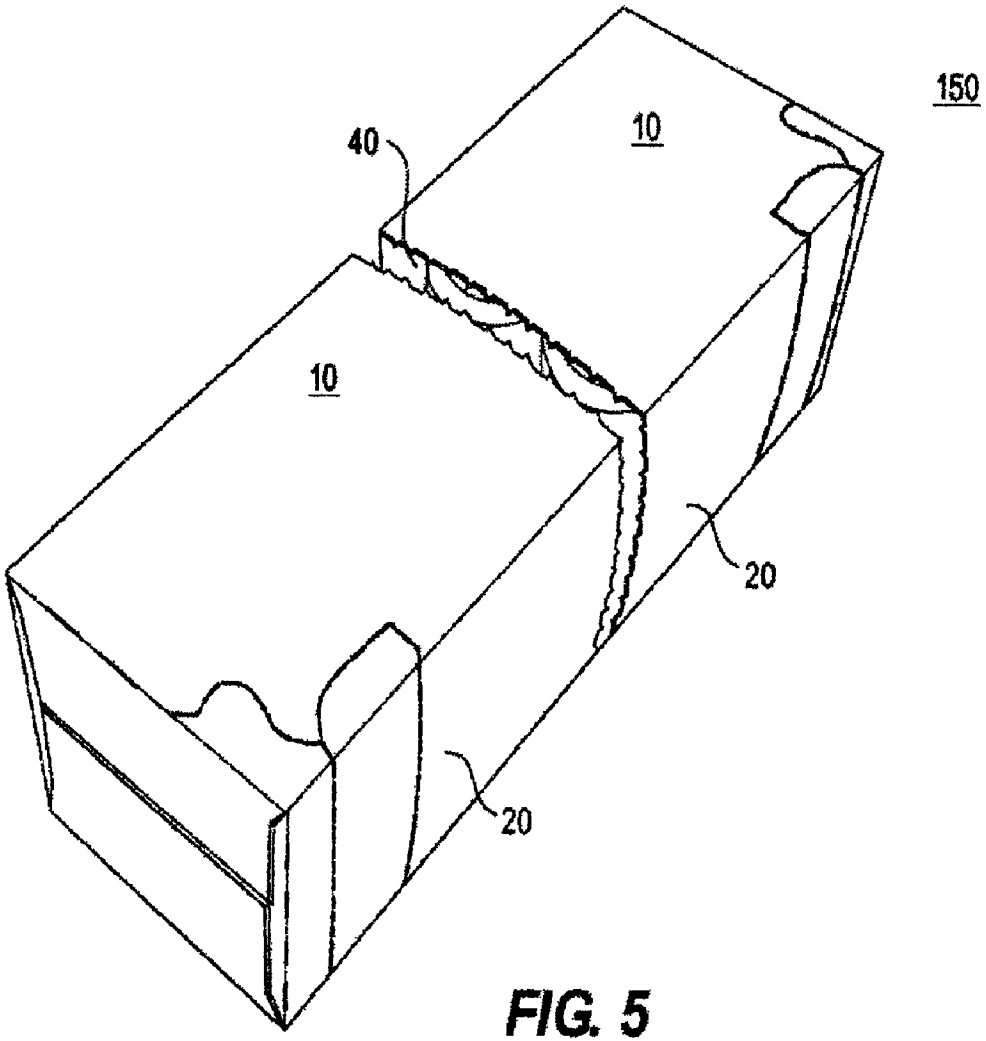

FIGS. 3-5, discussed in detail below, illustrate an exemplary method of placing the carton 150 into a first dispensing configuration.

Referring to FIG. 3, the tear strip 170 is grasped at the tear tab 78 and pulled so that the tear strip 170 is torn along the tear lines 72. Referring to FIG. 4, the tear strip 170 is further torn to separate the side panels 20 and then the side panels 10. As shown in FIGS. 1 and 2, the second tear feature 80 is adhered to the first tear feature 70 so that the tearing motion causes the second tear feature 80 to tear along the tear lines 82 and thereby separate the side panels 40. FIG. 5 illustrates the carton 150 with the tear strip 170 fully removed from the carton.

Referring to FIG. 6, the carton is folded or pivoted about the lateral hinge line 68 so that the third side panels 30 are adjacent to and facing one another. The carton is now in a first dispensing configuration comprising of a pair of hingedly connected, side-by-side carton sections 182 having dispenser openings 184 at the top of each section, and is designated by the reference numeral 180.

In the first dispensing configuration, each section 182 of the carton 180 accommodates six generally cylindrical containers C, arranged in two rows and three columns. In FIG. 6, the containers C are lying on their curved side surfaces, with longitudinal axes of the containers C being parallel to or aligned with a support surface of the sections 182, and aligned with the plane of the end panels 160 (FIG. 2). The longitudinal axes of the containers C, which pass through the top and bottom ends of the containers C, are transverse to the hinge line 68. The containers C are accessible through the dispenser openings 184. In the illustrated embodiment, the side-by-side carton sections 182 are identical or substantially identical. Variations may be introduced, however, to one or both of the sections 182 so that they are not identical. For example, the upper perimeter edge of the dispenser opening 184 of one or both of the carton sections 182 could be varied by changing the shape of one or more of the tear features 70, 80.

Referring to FIGS. 6 and 7, the carton 150 is placed in a second dispensing configuration by removing one or both of the dispenser sections 102 from the carton sections 182. As shown in FIG. 7, the containers C can now be pulled through dispenser openings 188 left after removing the dispenser sections 102, and/or through the dispenser openings 184 at the top of each carton section 182. The dispenser openings 188 are located at bottom portions of the carton sections 182 so that the containers C can be gravity-fed to a dispensing position at the openings 188.

In the illustrated embodiment, the carton sections 182 are hingedly connected while in the dispensing configuration, wherein the carton 150 is torn along three sides while a fourth side of the carton remains intact. In an alternative embodiment, the carton sections 182 may be separated from one another along the hinge 68 (e.g., by replacing the hinge with a breachable line of disruption) so that the carton is separated along four sides in order to place the carton 150 in the dispensing configurations.

EXAMPLE 1

A parallelepipedal carton 150 as illustrated in FIG. 2 accommodates twelve 12-fluid-ounce cylindrical containers C in a 2×6×1 arrangement. The width $W_1$ is about 4-⅞ in., and the width $W_2$ is about 5-⅛ in. The length $L_1$ is about 7-¾ in. In the dispensing configurations, each carton section 182 (FIG. 6) accommodates six containers C in a 2×3×1 arrangement.

Figure 9:
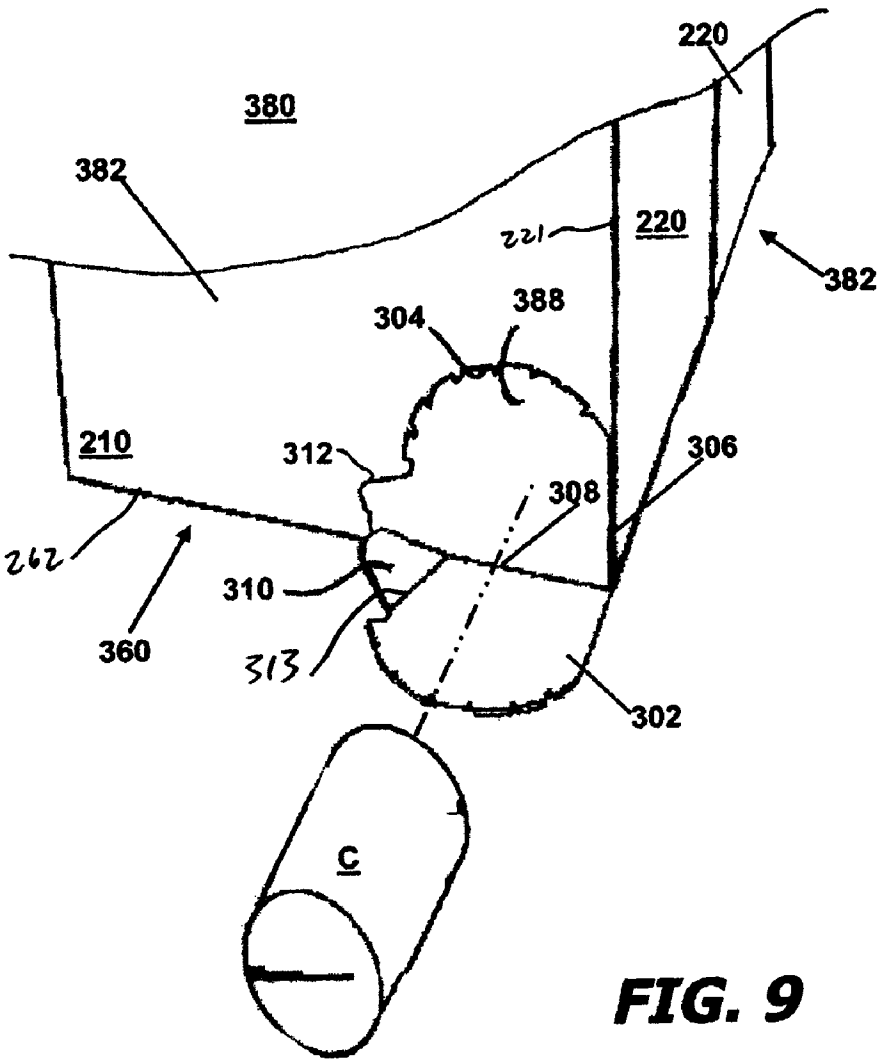
FIG. 9 illustrates the carton according to the second embodiment of the disclosure in a dispensing configuration.
Figure 8:
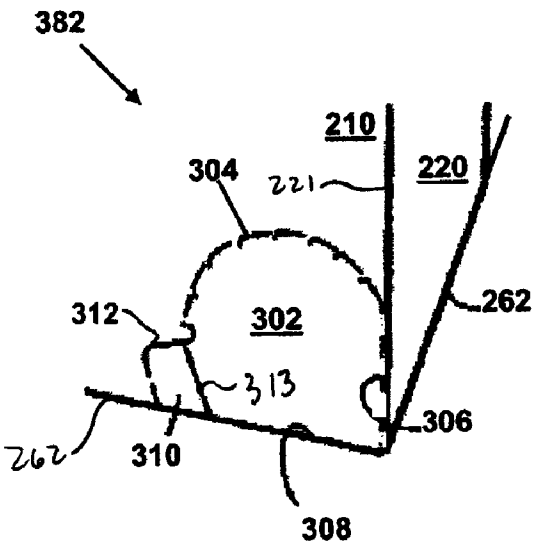
FIG. 8 illustrates a partial view of a carton according to a second embodiment of the disclosure.

FIGS. 8 and 9 illustrate a carton according to a second embodiment of the disclosure. FIG. 8 illustrates a lower corner of one carton section 382 having a dispenser section 302 formed therein. FIG. 9 is a partial view of the carton that has been placed in a dispensing configuration and is indicated by the reference number 380. The dispensing carton configuration 380 can be similar to the dispensing carton illustrated in FIG. 7, and can be constructed from a blank that is similar to the blank shown in FIG. 1. Like or similar elements in FIGS. 8 and 9 to those of FIG. 7 are indicated by like reference numbers, with the reference numbers in FIGS. 8 and 9 being preceded by a "2" or "3". The reference numbers of like or similar features of FIGS. 8 and 9 also can be characterized as having 200 added to the corresponding reference numbers showing correspondingly like or similar elements of FIG. 7. In the dispensing configuration, the carton 380 has been folded or pivoted about a hinge line (not shown but identical or similar to the hinge line 68 of FIG. 7) so that the carton sections 382 are adjacent to one another. The carton 380 then comprises a pair of hingedly connected side-by-side carton sections 382. Each carton section 382 can have an open top section as do the carton sections 182 in FIG. 7.

In the embodiment of FIGS. 8 and 9, each dispenser section 302 is defined by lines of disruption 304, 306, 308 in a respective first side panel 210. The lines of disruption 304, 306, 308 may be, for example, tear lines located at the bottom outer corners of the carton sections 382 that allow the dispenser sections 302 to be removed from the carton sections 382. In the illustrated embodiment, the line of disruption 308 is a fold line that comprises a portion of the lateral fold line 262. A graspable tab portion 310 can be defined in each first side panel 210 by a tear line 312 to facilitate opening of the dispenser sections 302. The tab portion 310 can be foldably connected to the dispenser section 302 by a fold line 313. As shown in FIG. 9, the tab portion 310 can be grasped to tear the dispenser section 302 along the tear lines 304, 306 and remain foldably attached to a carton section 382 at the line 308. If desired, the dispenser sections 302 can be removed by tearing along the line 308. Opening the bottom corner of a carton section 382 leaves a dispenser opening 388 through which containers C can be removed from the first side panels 210 of each carton section.

In the dispensing configuration, each carton section 382 initially accommodates six generally cylindrical containers C, arranged in three rows and two columns. The "columns" of containers C in the carton sections 382 are stacked in a vertical arrangement and can alternatively be referred to as "layers" of containers C. In FIG. 9, the containers C are lying on their curved side surfaces, with longitudinal axes of the containers C being parallel to or aligned with a support surface of the carton 380, and aligned with the plane of the end panels 360 on which the carton sections 382 rest. The containers C in the carton sections 382 are accessible through the dispenser openings 388.

The dispensing sections 302 are similar to the dispenser shown and described in copending U.S. utility patent application Ser. No. 11/970,801, which was filed on Jan. 8, 2008. The entire contents of the above-referenced utility application is hereby incorporated by reference for all purposes as if presented herein in their entirety.

Figure 10:
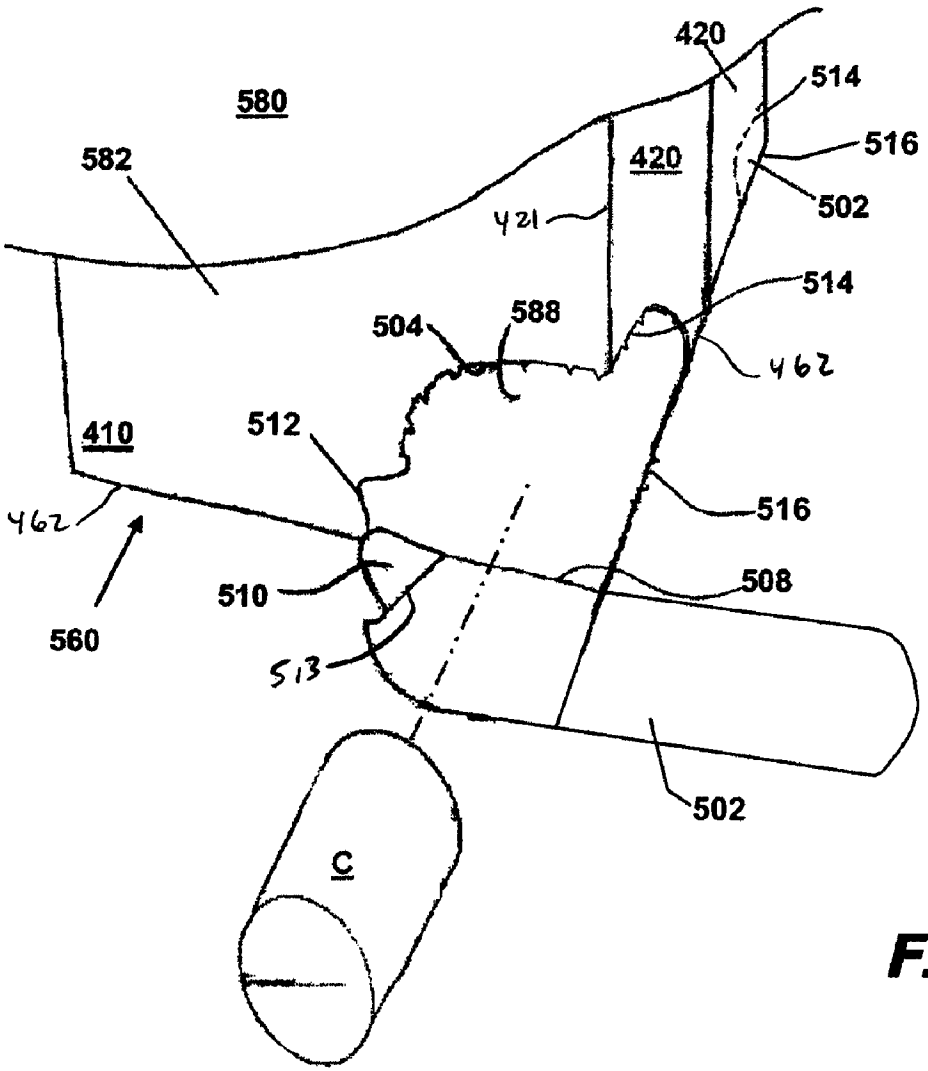
FIG. 10 illustrates a carton according to a third embodiment of the disclosure in a dispensing configuration.

FIG. 10 illustrates a carton according to a third embodiment of the disclosure that has been placed in a dispensing configuration and is indicated by the reference number 580. The dispensing carton configuration 580 can be substantially identical to the dispensing carton configuration 380 illustrated in FIG. 9, and like elements in FIG. 10 to those of FIG. 9 are indicated by like reference numbers, with the reference numbers in FIG. 10 preceded by a "4" or "5." The reference numbers of like or similar features of FIG. 10 also can be characterized as having 400 added to the corresponding reference numbers showing correspondingly like or similar elements of FIG. 7 or 200 added to the corresponding reference numbers showing like or similar elements of FIG. 9. The carton of FIG. 10 differs from the carton of FIG. 9 in that the dispenser section 582 that forms the dispenser opening 588 comprises a portion of the first side panels 410 and a portion of the second side panels 420 at the front of the dispensing carton 580. In the illustrated embodiment, the bottom corners of the adjacent carton sections 582 can be opened. In FIG. 10, a dispenser section 502 of one of the carton sections 582 has been opened.

The dispenser sections 502 are defined by lines of disruption 504, 508, 514, 516 at the bottom outer corners of the carton sections 582. In the illustrated embodiment, line of disruption 504 is in the first side panel, line of disruption 514 is in the second end panel, and lines of disruption 508, 516 are coincident with respective portions of the fold line 462. The lines of disruption 504, 508, 514, 516 may be, for example, tear lines that allow the dispenser sections 502 to be removed from the carton sections 582. In the illustrated embodiment, line of disruption 508 is a fold line. As shown in FIG. 10, a graspable tab portion 510 is defined in a respective first side panel 410 by a tear line 512 and is foldably connected to each dispenser section 502 at a fold line 513 to facilitate opening of the dispenser sections 502. Opening the bottom corner of a carton section 582 by removing the dispenser section 502 leaves a dispenser opening 588 through which containers C can be removed from the carton section.

Figure 11:
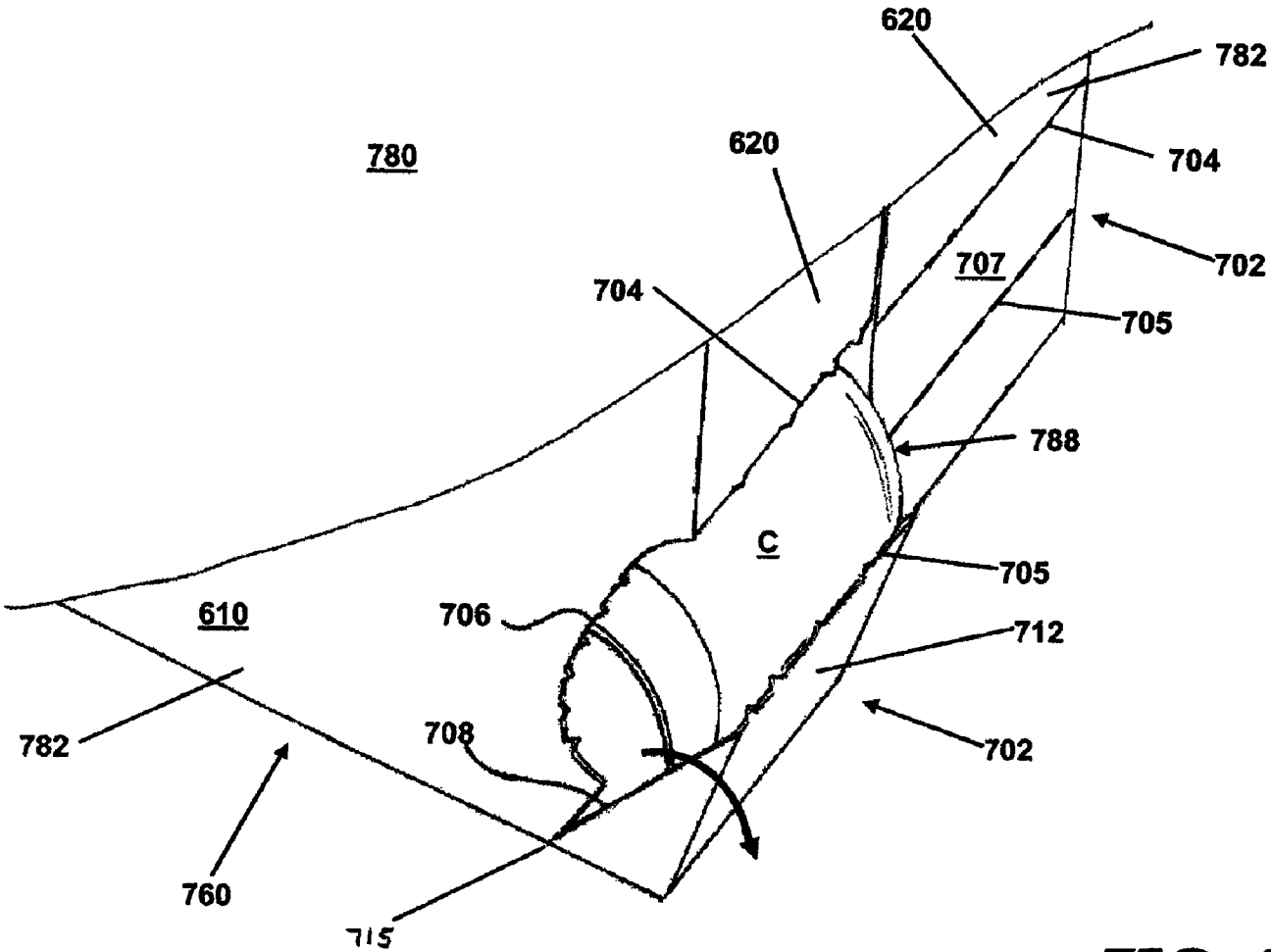
FIG. 11 illustrates a carton according to a fourth embodiment of the disclosure in a dispensing configuration.

FIG. 11 illustrates a carton according to a fourth embodiment of the disclosure that has been placed in a dispensing configuration and indicated by the reference number 780. The dispensing carton configuration 780 can be similar to the dispensing carton illustrated in FIG. 7, and can be constructed from a blank that is similar to the blank shown in FIG. 1. Like elements in FIG. 11 to those of FIG. 7 are indicated by like reference numbers, with the reference numbers in FIG. 11 being preceded by a "6" or "7." The reference numbers of like or similar features of FIG. 11 also can be characterized as having 600 added to the corresponding reference numbers showing correspondingly like or similar elements of FIG. 7. In the dispensing configuration, the carton 780 has been folded or pivoted about a hinge line (not shown but similar to hinge line 68 of FIG. 7) so that the carton sections 782 are adjacent to one another. The carton 780 then comprises a pair of hingedly connected side-by-side carton sections 782. Each carton section 782 can have an open top section as do the carton sections 182 in FIG. 7.

Dispenser sections 702 are defined by lines of disruption 704, 705, 706, 708, 715 at the bottom front portions of the carton sections 782. In the illustrated embodiment, the lines of disruption 706, 708 are in the first side panel 610, the lines of disruption 704, 705 are in the second side panel 620, and the line of disruption 715 is a fold line that extends across the end flaps (not shown but similar to end flaps 12, 32 of FIG. 7) that form the end panel 760. The lines of disruption 704, 705, 706, 708 may be, for example, tear lines, and the line 715 may be, for example, a fold or bend line extending across the end panel 760 that forms a respected bottom of each carton section 782. A removable strip 707 is defined by the tear lines 704, 705, 706. The generally symmetrical removable strip 707 is further defined by a tear line 706 in the third side panel (not shown) corresponding to the tear line 706 in the first side panel 610, though it is not visible in FIG. 11. Alternatively, the removable strip 707 can be asymmetrical. The dispenser sections 702 may be opened by tearing the strip 707 away along the tear lines 704, 705, 706. The bottom doors 712 can then be pivoted open by breaching the sections 702 along the lines of disruption 708 and pivoting the doors 712 open along fold or bend lines 715. Opening the bottom of a carton section 782 by removing the dispenser section 902 leaves a dispenser opening 788 through which containers C can be removed from the carton section by pivoting open the door 712 about the line 715. In FIG. 11, a dispenser section 702 of one of the carton sections 782 has been opened.

In the dispensing configuration, each carton section 782 initially accommodates six generally cylindrical containers C, arranged in three rows and two columns. The "columns" of containers C in the carton sections 782 are stacked in a vertical arrangement and can alternatively be referred to as "layers" of containers C. In FIG. 11, the containers C are lying on their curved side surfaces, with longitudinal axes of the containers C being parallel to or aligned with a support surface of the carton 780, and aligned with the plane of the end panels 760 on which the carton sections 782 rest. The containers C in the carton sections 782 are accessible through the dispenser openings 788.

The dispensing sections 702 are similar to the dispenser shown and described in copending U.S. utility patent application Ser. No. 11/261,258, which was filed on Oct. 28, 2005. The entire contents of the above-referenced utility application is hereby incorporated by reference for all purposes as if presented herein in their entirety.

Figure 12:
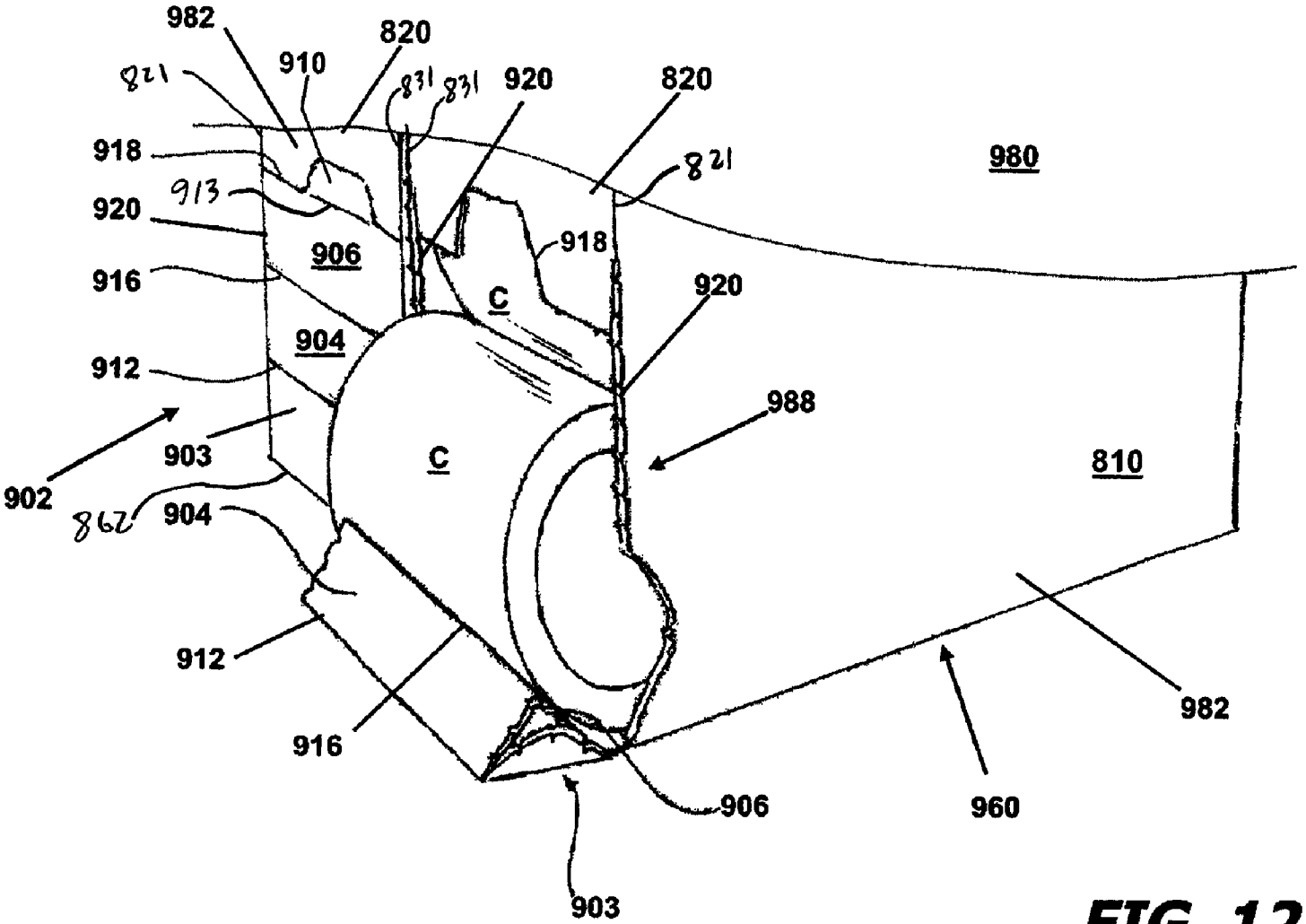
FIG. 12 illustrates a carton according to a fifth embodiment of the disclosure in a dispensing configuration.

FIG. 12 illustrates a carton according to a fourth embodiment of the disclosure that has been placed in a dispensing configuration and indicated by the reference number 980. The dispensing carton configuration 980 can be similar to the dispensing carton illustrated in FIG. 7, and can be constructed from a blank that is similar to the blank shown in FIG. 1. Like elements in FIG. 12 to those of FIG. 7 are indicated by like reference numbers, with the reference numbers in FIG. 12 being preceded by a "8" or "9." The reference numbers of like or similar features of FIG. 12 also can be characterized as having 800 added to the corresponding reference numbers showing correspondingly like or similar elements of FIG. 7. In the dispensing configuration, the carton 980 has been folded or pivoted about a hinge line (not shown but similar to the hinge line 68 of FIG. 7) so that the carton sections 982 are adjacent to one another. The carton 980 then comprises a pair of hingedly connected side-by-side carton sections 982. Each carton section 982 can have an open top section as do the carton sections 182 in FIG. 7.

Dispenser sections 902 are formed in bottom front sections of the carton sections 982. The dispenser sections 902 each include a plurality of stop sections 903, 904, 906 in a respective second side panel 820. The stop sections 903 and 904 are connected at fold or hinge line 912, and the stop sections 904 and 906 are connected at fold or hinge line 916. The perimeters of each dispenser section 902 is defined by a breachable line of disruption 918 extending across the second side panel 820 and breachable lines of disruption 920 that are collinear with portions of the longitudinal fold lines 821, 831. The breachable lines of disruption 918, 920 can be, for example, tear lines. The dispenser sections 902 may be opened by tearing along the tear lines 918, 920. A graspable tab portion 910 can be defined at each dispenser section 902 by the tear line 918 and fold line 913. The tab portion 910 facilitates opening of the dispenser sections 902 and facilitates the formation of the dispenser sections into a triangular stop configuration. The stop sections 903, 904, 906 are folded into the triangular stop configuration shown in the right side carton section 982 by inserting the tab portion 910 into a slot formed in the end panel 960 (not shown). The slot for receiving the tab portion 910 can be located in one or more of the end flaps (not shown in FIG. 12 but similar to the end flaps 12, 22, 32, 42) forming the end panel 960. Alternatively, the slot can be located in (e.g. be collinear with at least a portion of) the fold line 862 that connects the end flaps that form the end panel 960. The containers C in the carton sections 982 are accessible through the dispenser openings 988.

In the dispensing configuration, each carton section 982 initially accommodates six generally cylindrical containers C, arranged in three rows and two columns. The "columns" of containers C in the carton sections 982 are stacked in a vertical arrangement and can alternatively be referred to as "layers" of containers C. In FIG. 12, the containers C are lying on their curved side surfaces, with longitudinal axes of the containers C being parallel to or aligned with a support surface of the carton 980, and aligned with the plane of the end panels 960 on which the carton sections 982 rest. The containers C in the carton sections 982 are accessible through the dispenser openings 988.

The dispensing sections 902 are similar to the dispenser shown and described in copending U.S. utility patent application Ser. No. 11/443,984, which was filed on May 31, 2006. The entire contents of the above-referenced utility application is hereby incorporated by reference for all purposes as if presented herein in their entirety.

In the above embodiments, the exemplary cartons are described as accommodating twelve, 12-ounce, cylindrical beverage containers C in 2×6×1 configurations. Other arrangements of containers, packages, articles, and other items, however, can be accommodated within a carton constructed according to the principles of the present disclosure. For example, a carton constructed according to the principles of the present disclosure would also function satisfactorily if the carton were sized and shaped to hold articles in other configurations, such as 2×4×1, 2×8×1, 3×4×1, 3×6×1, 4×4×1, 4×6×1, etc., and multi-tier variations of the aforementioned configurations.

The dimensions of the exemplary blanks may be altered, for example, to accommodate various container forms. For example, 16-ounce, 18-ounce or 20-ounce petaloid bottle containers, or other beverage bottle containers, such as plastic bottles having longitudinal axes, may be accommodated within cartons constructed according to the principles of the present disclosure. In such arrangements, the first or bottom ends of the bottles could be adjacent to the second or fourth side panel pairs.

In accordance with the exemplary embodiments, the blanks may be constructed of paperboard. The blanks can also be constructed of other materials, such as cardboard, hard paper, solid unbleached sulfate (SUS) board, or any other material having properties suitable for enabling the carton to function as described above. The blanks can also be laminated to one or more sheet-like materials at selected panels or panel sections.

The interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

For purposes of the description presented herein, the term "line of disruption" can be used to generally refer to cut lines, tear lines, crease lines, score lines, and fold lines (or overlapping and/or sequential combinations of at least one cut line, crease line, score line, tear line, or fold line). A "breachable line of disruption" is a line of disruption that is intended to be breached during ordinary use of the carton, such as when placing the carton in a dispensing configuration. An example of a breachable line of disruption is a tear line.

In accordance with the above-described embodiments of the present disclosure, a fold line can be any substantially linear, although not necessarily straight, line of disruption or other form of weakening that facilitates folding therealong. More specifically, but not for the purpose of narrowing the scope of the present disclosure, fold lines include: score lines; cuts that extend partially into a material along the desired line of weakness, and/or a series of cuts that extend partially into and/or completely through the material along the desired line of weakness; and various overlapping and/or sequential combinations of these disruptions in blanks.

In the present specification, a "panel" or "flap" need not be flat or otherwise planar. A "panel" or "flap" can, for example, comprise a plurality of interconnected generally flat or planar blank sections.

Although each side panel is shown with a corresponding end flap, the side panels could alternatively not all include end flaps and a blank could be provided with enough end flaps only to close each end of the cartons.

The above embodiments may be described as having one or more panels adhered together by glue during erection of the carton embodiment. The term "glue" is intended to encompass all types of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A blank for forming a carton, the carton being for holding a plurality of cylindrical containers in a dispensing configuration, the blank comprising:

a first section and a second section, each of the first and second sections comprising a first side panel, a second side panel foldably attached to the first side panel, a third side panel foldably attached to the second side panel, a fourth side panel foldably attached to the third side panel, and a first end flap, a second end flap, a third end flap, and a fourth end flap, each end flap being respectively foldably attached to one of the first side panel, second side panel, third side panel, and fourth side panel along a lateral fold line, the end flaps being arranged along respective marginal areas of the blank;

a tear feature extending between at least a portion of the first section and the second section and separating the first side panels, the second side panels, and the fourth side panels, the tear feature comprising a first tear feature extending across the first and second side panels and a second tear feature extending across the fourth side panels;

a hinge extending across at least the third side panels and extending from respective ends of the first and second tear features; and a dispenser pattern forming a dispenser section that is at least partially removable to form a dispenser opening in at least one of the first and second sections in the carton formed from the blank, the dispenser section comprising at least a portion of at least one of the first side panel of the first section and the second side panel of the first section, wherein the dispenser section is at least partially defined by a dispenser fold that is collinear with the lateral fold line of the first section.

2. The blank of claim 1, the dispenser section comprising at least a portion of both the first side panel of the first section and at least a portion of the second side panel of the first section.

3. The blank of claim 1, the dispenser section comprising only a portion of the first side panel of the first section.

4. The blank of claim 1, the dispenser pattern further comprising a hinge line spaced apart from the dispenser section and being for expanding the dispenser opening.

5. The blank of claim 1, the dispenser section further comprising at least a portion of the third side panel of the first section.

6. The blank of claim 5 wherein the dispenser pattern comprising at least one tear line in the first side panel of the first section, at least one tear line in the second side panel of the first section, and at least one tear line in the third side panel of the first section.

7. The blank of claim 6 wherein the at least one tear line in the second side panel comprises two tear lines, the two tear lines being generally parallel and extending laterally across the second side panel of the first section.

8. The blank of claim 7, the first section comprising a bottom door adjacent to the dispenser section that is pivotable about a fold line extending across at least one of the first end flap, second end flap, third end flap, and fourth end flap.

9. The blank of claim 1, the dispenser pattern defining a perimeter of the dispenser section and comprising a tear line extending across the second side panel and at least one fold line spaced apart from the tear line.

10. The blank of claim 9, the dispenser section comprising at least two stop sections, the stop sections being foldably connected by the at least one fold line.

11. The blank of claim 10 wherein the dispenser pattern comprises three fold lines and the dispenser section comprises three stop sections, the stop sections being respectively foldably connected by a respective one of the fold lines, the dispenser section being foldably connected to the second side panel of the first section by one of the fold lines.

12. The blank of claim 11 wherein the dispenser section comprises a tab section and the dispenser section is positionable into a triangular stop configuration when the blank is formed into carton.

13. The blank of claim 1, further comprising a second dispenser pattern in the second section.

14. The blank of claim 13, the second dispenser pattern having a similar configuration to that of the first dispenser pattern.

15. The blank of claim 1, wherein the dispenser pattern comprises a dispenser tear line that is collinear with the lateral fold line.

16. The blank of claim 15, wherein the dispenser fold at least partially defines at least a first portion of the dispenser section extending in the first side panel, and the dispenser tear line at least partially defines at least a second portion of the dispenser section extending in the second side panel.

17. The blank of claim 16, wherein the dispenser tear line is a first dispenser tear line, and the dispenser pattern further comprises a second dispenser tear line extending at least partially across the first side panel and the second side panel.

18. A carton for holding a plurality of containers and having a dispensing configuration, the carton comprising:

a first section and a second section, each of the first and second sections comprising a first side panel, a second side panel foldably attached to the first side panel, a third side panel foldably attached to the second side panel, a fourth side panel foldably attached to the third side panel, a first end flap, a second end flap, a third end flap, and a fourth end flap, each end flap being respectively foldably attached to one of the first side panel, second side panel, third side panel, and fourth side panel along a lateral fold line, the end flaps being arranged along respective marginal areas of the side panels and forming an end panel;

a tear feature extending between at least a portion of the first section and the second section and separating the first side panels, the second side panels, and the fourth side panels, the tear feature comprising a first tear feature extending across the first and second side panels and a second tear feature extending across the fourth side panels;

a hinge extending across at least the third side panels and extending from respective ends of the first and second tear features; and a dispenser section that is removable to form a dispenser opening in at least one of the first and second sections, the dispenser section being formed by a dispenser pattern and comprising at least a portion of at least one of the first side panel of the first section and the second side panel of the first section, wherein the dispenser section is at least partially defined by a dispenser fold that is collinear with the lateral fold line of the first section.

19. The carton of claim 18, the dispenser section comprising at least a portion of both the first side panel of the first section and at least a portion of the second side panel of the first section.

20. The carton of claim 18, the dispenser section comprising only a portion of the first side panel of the first section.

21. The carton of claim 18, the dispenser pattern further comprising a hinge line spaced apart from the dispenser section and being for expanding the dispenser opening.

22. The carton of claim 18, the dispenser section further comprising at least a portion of the third side panel of the first section.

23. The carton of claim 22 wherein the dispenser pattern comprising at least one tear line in the first side panel of the first section, at least one tear line in the second side panel of the first section, and at least one tear line in the third side panel of the first section.

24. The carton of claim 23 wherein the at least one tear line in the second side panel comprises two tear lines, the two tear lines being generally parallel and extending laterally across the second side panel of the first section.

25. The carton of claim 24, the first section comprising a bottom door adjacent to the dispenser section that is pivotable about a fold line extending across at least one of the first end flap, second end flap, third end flap, and fourth end flap.

26. The carton of claim 18, the dispenser pattern defining a perimeter of the dispenser section and comprising a tear line extending across the second side panel and at least one fold line spaced apart from the tear line.

27. The carton of claim 26, the dispenser section comprising at least two stop sections, the stop sections being foldably connected by the at least one fold line.

28. The carton of claim 27 wherein the dispenser pattern comprises three fold lines and the dispenser section comprises three stop sections, the stop sections being respectively foldably connected by a respective one of the fold lines, the dispenser section being foldably connected to the second side panel of the first section by one of the fold lines.

29. The carton of claim 28 wherein the dispenser section comprises a tab section and the dispenser section is positionable into a triangular stop section when the blank is formed into carton.

30. The carton of claim 29 wherein the cart comprises a slot in the end flap that received the tab section when the dispenser section is positioned into the triangular stop section.

31. The carton of claim 18, further comprising a second dispenser pattern in the second section.

32. The carton of claim 31, the second dispenser pattern having a similar configuration to that of the first dispenser pattern.

33. The carton of claim 18, wherein the dispenser pattern comprises a dispenser tear line that is collinear with the lateral fold line.

34. The carton of claim 33, wherein the dispenser fold at least partially defines at least a first portion of the dispenser section extending in the first side panel, and the dispenser tear line at least partially defines at least a second portion of the dispenser section extending in the second side panel.

35. The blank of claim 34, wherein the dispenser tear line is a first dispenser tear line, and the dispenser pattern further comprises a second dispenser tear line extending at least partially across the first side panel and the second side panel.

36. A method of dispensing articles from a carton, comprising:

providing a plurality of articles;

loading the plurality of articles in a carton such that the articles are in at least two rows and at least two columns, the carton comprising a first side panel, a second side panel foldably connected to the first side panel, a third side panel foldably connected to the second side panel, and a fourth side panel foldably connected to the third side panel, at least one end flap foldably connected to one of the side panels along a lateral fold line and at least partially closing an end of the carton;

separating the carton into a first carton section and a second carton section by tearing a first tear feature extending across the first and second side panels and a second tear feature extending across the fourth side panel, the first carton section and the second carton section being hingedly connected along a hinge extending across at least the third side panel and extending from respective ends of the first and second tear features, and each of the first carton section and the second carton section comprising respective portions of the first side panel, the second side panel, the third side panel, and the fourth side panel, wherein the first carton section accommodates a first plurality of the plurality of articles and has a first open top through which the first plurality of articles can be dispensed, the first carton section further comprising a first dispenser section being formed by a dispenser pattern and comprising at least a portion of at least one of the first side panel of the first section and the second side panel of the first section, wherein the dispenser section is at least partially defined by a dispenser fold that is collinear with the lateral fold line, and the second carton section accommodates a second plurality of the plurality of articles and has a second open top through which the second plurality of articles can be dispensed.

37. The method of claim 36, further comprising the steps of:

opening the first dispenser section; and removing an article from the first carton section through the opened first dispenser section.

38. The method of claim 36, wherein the first and second carton sections are placed in a side-by-side configuration.

39. The method according to claim 38, each of the articles comprising a longitudinal axis that is transverse to the hinge.

40. The method according to claim 39, wherein the number of articles in the first plurality of articles is equal to the number of articles in the second plurality of articles.

41. The method according to claim 40, wherein the plurality of articles comprises at least eight articles.

* * * * *